US005493973A

United States Patent [19]

Brion et al.

[11] Patent Number: 5,493,973

[45] Date of Patent: Feb. 27, 1996

[54] MANUFACTURING PROCESS FOR A CONTAINER FOR PROPULSIVE CHARGE AND THE CONTAINER THUS OBTAINED

[75] Inventors: Bernard Brion; Bernard Kotas, both of Bourges, France

[73] Assignee: Giat Industries, Versailles, France

[21] Appl. No.: 350,035

[22] Filed: Nov. 29, 1994

[30] Foreign Application Priority Data

Dec. 22, 1993 [FR] France ..... 93 15422

[51] Int. Cl.[6] ..... F42B 5/18; F42B 33/02; B21D 51/54

[52] U.S. Cl. ..... 102/431; 102/700; 29/1.3; 29/255; 86/10

[58] Field of Search ..... 86/1.1, 10, 24; 102/431, 432, 433, 331, 317, 700, 320, 332, 443, 430; 29/1.3, 801, 234, 235, 244, 252, 253, 255, 281.6

[56] References Cited

U.S. PATENT DOCUMENTS

| | | | |
|---|---|---|---|
| 542,103 | 7/1895 | Peters | 102/331 |
| 923,922 | 6/1909 | Wratzke | 102/430 |
| 3,176,617 | 4/1965 | Brafford | 102/97 |
| 3,831,522 | 8/1974 | Romney | 102/331 |
| 4,334,476 | 6/1982 | Day et al. | 102/331 |
| 4,557,029 | 12/1985 | Stewart | 29/253 |
| 4,598,445 | 7/1986 | O'Connor | 29/1.3 |
| 4,691,638 | 9/1987 | Meyer et al. | 102/430 |
| 4,826,637 | 5/1989 | Mavres et al. | 86/1.1 |
| 5,052,304 | 10/1991 | Rahnenfuhrer et al. . | |
| 5,256,203 | 10/1993 | Moore et al. | 29/1.3 |
| 5,282,423 | 2/1994 | Sikorski et al. | 102/431 |

FOREIGN PATENT DOCUMENTS

| | | | |
|---|---|---|---|
| 373760 | 5/1907 | France . | |
| 1514293 | 5/1907 | France . | |
| 2614096 | 10/1988 | France . | |
| 3704792 | 9/1988 | Germany | 29/1.3 |
| 0112583 | 10/1978 | Japan | 29/252 |
| 1574427 | 6/1990 | U.S.S.R. | 29/252 |
| 2031838 | 4/1980 | United Kingdom | 102/331 |
| 2194024 | 2/1988 | United Kingdom . | |
| 2259753 | 3/1993 | United Kingdom | 102/430 |

*Primary Examiner*—Charles T. Jordan
*Assistant Examiner*—Theresa M. Wesson
*Attorney, Agent, or Firm*—Oliff & Berridge

[57] ABSTRACT

A container manufacturing process includes forming a tubular case of combustible material; forming two covers of combustible material, each cover including a base integral with a cylindrical edge having an external diameter equal to the internal diameter of the case. Each cover has at least one edge of sufficient length to permit the positioning of the cover with part of the edge located outside of the case to be able to receive a tubular extension integral with another container or another interconnecting ring. Positioning of the covers with respect to the case is achieved using structure allowing selective positioning of at least one cover in at least two different axial positions that include selected positions in which the base is outside of the case, the base is inside the case or the base is at the ends of the case. The covers and the case are connected using attachment structure such as glue.

17 Claims, 5 Drawing Sheets

MANUFACTURING PROCESS FOR A CONTAINER FOR PROPULSIVE CHARGE AND THE CONTAINER THUS OBTAINED

BACKGROUND OF THE INVENTION

The present invention concerns combustible containers designed to include a propulsive charge and processes for manufacturing such containers.

To adjust the firing range of a gun, it is often necessary to modify the amount of powder used to launch a projectile.

Substantially cylindrical modular containers made of combustible material have already been designed. Because of their rigidity, such containers are easier to use than traditional bags of powder.

U.S. Pat. No. 5,052,304 describes, for instance, a modular container having two shells, each having a base extending in the form of a cylindrical envelope. The shells are assembled at the ends of their envelopes.

This solution is costly because complementary cylindrical-bearing surfaces are needed on the envelopes for assembly. These bearing surfaces have to be produced with precision to avoid extra thickness at the assembly, which would prevent the introduction of the container into the chamber of the weapon.

In addition, this method of assembly implies a different shape for each shell, further increasing container production costs.

SUMMARY OF THE INVENTION

One object of the invention is to propose a simple and inexpensive propulsive-charge container-manufacturing process capable of producing different types of containers of different shapes and sizes at the lowest cost with the minimum number of parts.

Another object of the invention is to provide a container for a propulsive charge, which is of a simple and inexpensive design, and that allows easy loading into the chamber of the weapon.

Accordingly, the invention provides a container-manufacturing process for propulsive charges. The process includes the following steps:

a tubular case is made of combustible material, using combustible material, two covers are made, comprising a base integral with a cylindrical edge having an outside diameter equal to the inside diameter of the case, one cover at the least, having a sufficiently long edge to permit the positioning of the cover with part of the edge arranged outside of the case in order to accommodate a tubular extension integral with another container or an interconnecting ring, the covers are positioned with respect to the case, using structure allowing positioning of at least one cover with, at least two different axial positions, i.e.: the base outside of the case, the base inside the case or the base at the ends of the case, the covers and the case are made integral by an attachment device.

In one embodiment, the positioning device includes a tool having a plate for axially positioning the base with respect to the case in several determined positions.

In a second embodiment, the positioning device may include radial openings that are provided with holes on at least one end of the container and are set out regularly on at least one circular crown. The openings are designed to accommodate pins made integral with a cover to provide connection by clipping together the cover and the case, while the drilling structure provides the structure for setting the circular crown in different axial positions on the case so that the cover may be attached in the desired position.

In a third embodiment, the structure for positioning may include at least two annular grooves on at least one end of the container, designed to receive a holster integral with a cover to provide connection by clipping together the cover and the case in at least two relative axial positions between the cover and the case.

In a fourth embodiment, the structure for positioning may include at least one threaded profile provided on the case that is designed to work with the complementary profile provided on the edge of a cover.

The invention also concerns a container for propulsive charges wherein a case of combustible material is closed at either end by a cover also made of combustible material and has a base integral with a cylindrical edge whose outside diameter equals the inside diameter of the case, the covers being connected to the case by clipping them together.

The clipping structure can include radial openings provided on at least one end of the case, set out regularly on at least one circular crown, designed to accommodate the pins integral with a cover.

The case can include on at least one of its ends, radial openings set out regularly on at least two circular crowns, designed to receive the pins integral with a cover and provide connection by clipping between the cover and the case, in at least two relative axial positions of the cover and the case.

In one variant, the clipping structure can include at least two annular grooves provided on the inner surface of the case and at least one end of the container, designed to accommodate a bolster integral with a cover and to provide connection by clipping between the cover and the case in at least two axial positions of the cover and the case.

The container, according to the invention, can include on one internal cylindrical surface, at least one threaded profile designed to work together with a complementary profile supported by the edge of a cover.

In one embodiment, the covers may be attached in such a way that:

the first end of the container bears a single cover, the end of which is placed inside the case, so that the container forms a tubular extension at its initial end, the second end of the container bears a second cover, of which part of the cylindrical edge is outside of the case, thus forming a restriction designed to accommodate a tubular extension of the other container, the length of this restriction is more or less equal to that of the tubular extension.

In another embodiment, the covers are attached in such a way that their cylindrical edges are located outside of the case, thus forming a restriction at either end.

In another embodiment, the covers are attached in such a way that their bases are substantially at the level of the case ends.

BRIEF DESCRIPTION OF THE DRAWINGS

Other advantages of the invention will appear in the following description of the various embodiments, which refer to the attached illustrations wherein.

DETAILED DESCRIPTION OF PREFERRED EMBODIMENTS

Figure 1:
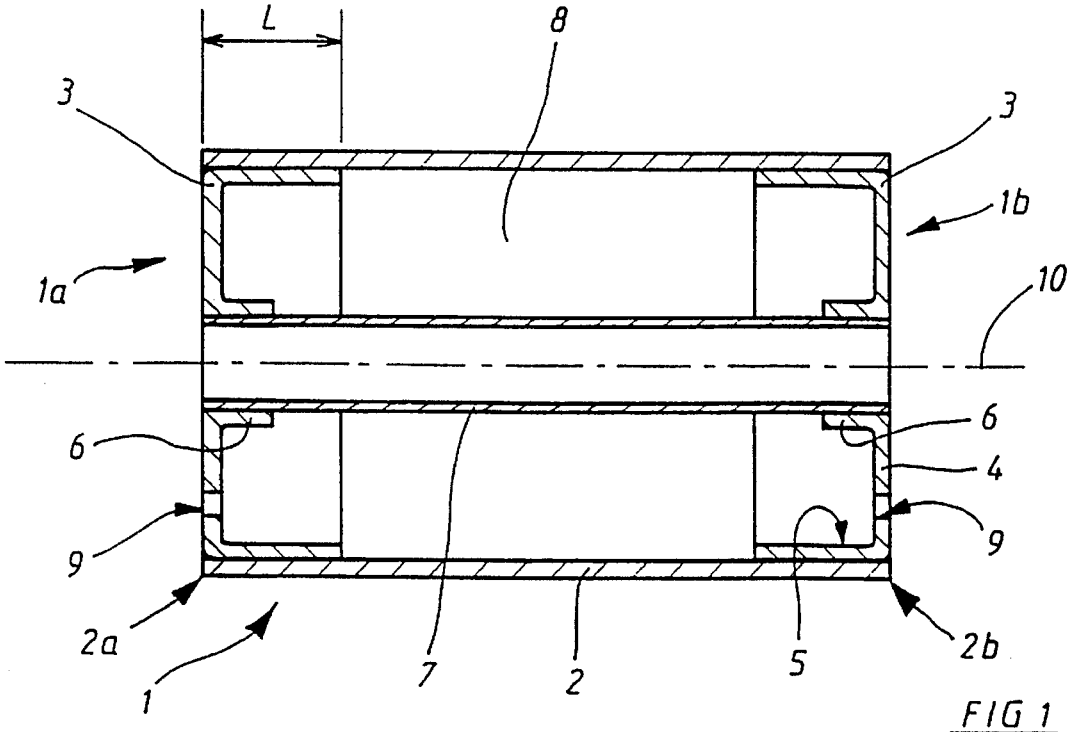
FIG. 1 is a longitudinal half-sectional view of the first container obtained with the process according to the invention.

With reference to FIG. 1, a container 1, obtained using the process according to the invention, includes a cylindrical tubular case 2 made of combustible material, for instance, nitro-cellulose-filled carton, closed at each end by a cap 3, also made of combustible material.

The two covers 3 are identical, and each includes a base 4 integral with a cylindrical edge 5.

The outside diameter of edge 5 is equal to the inside diameter of case 2, so that the cover may be positioned in the case and attached by gluing.

Length L of edge 5 is chosen relatively generously for reasons explained in the following. A considerable length L also increases the rigidity and the mechanical strength of the container.

Practically, for a case and covers made of carton approximately 3 mm thick, edge 5 will have a length greater than or equal to one-quarter of the internal diameter of case 2 (for instance, 50 mm for an outside diameter of 158 mm).

Each cover will include an axial cylindrical collar 6 on which a cylindrical conduit 7 will be positioned. Conduit 7 will also be made of combustible material and attached to each of tile covers by gluing onto collars 6.

Container 1 is designed to accommodate, in its internal volume 8, a propulsive powder (in bulk or in bundles) of a known type that is not represented.

The powder is inserted into container 1 through an opening 9 provided in cover 3 and sealed after filling by a sheet of paper or by an appropriate plug.

Conduit 7 is designed to accommodate an ignition system of a known type that is not represented, formed for instance by a stack of compressed black-powder rings.

In an advantageous embodiment, after positioning the powder and ignition system, both openings 9 and the ends of conduit 7 will be sealed using paper caps bonded onto the outer surfaces of the two covers 3.

A container like this is substantially symmetrical about its axis 10. It is also symmetrical with respect to its central plane at right angles to axis 10.

Thus, the container can be positioned in the chamber of a weapon in any orientation, advantageous from the operation point of view, in particular with automatic loading systems.

The container can be stacked with other identical containers in order to form a propulsive charge.

The various containers forming a charge will be in contact on the planar front surfaces 1*a* and 1*b* of clovers 3. These front surfaces 1*a* and 1*b* will be connected to the external cylindrical surface of case 2 by acute angles 2*a* and 2*b*. This arrangement provides that the stack will be stable in the containers, and will facilitate their handling in the chamber of the weapon by known means of retention, even when the weapon is steeply inclined.

This container also offers a considerable advantage over known containers in which the front surfaces are connected to the outer cylindrical surface by a rounded profile that favors the misalignment of the various containers of the stack and prevents their easy maintenance in the chamber of the weapon.

Figure 2:
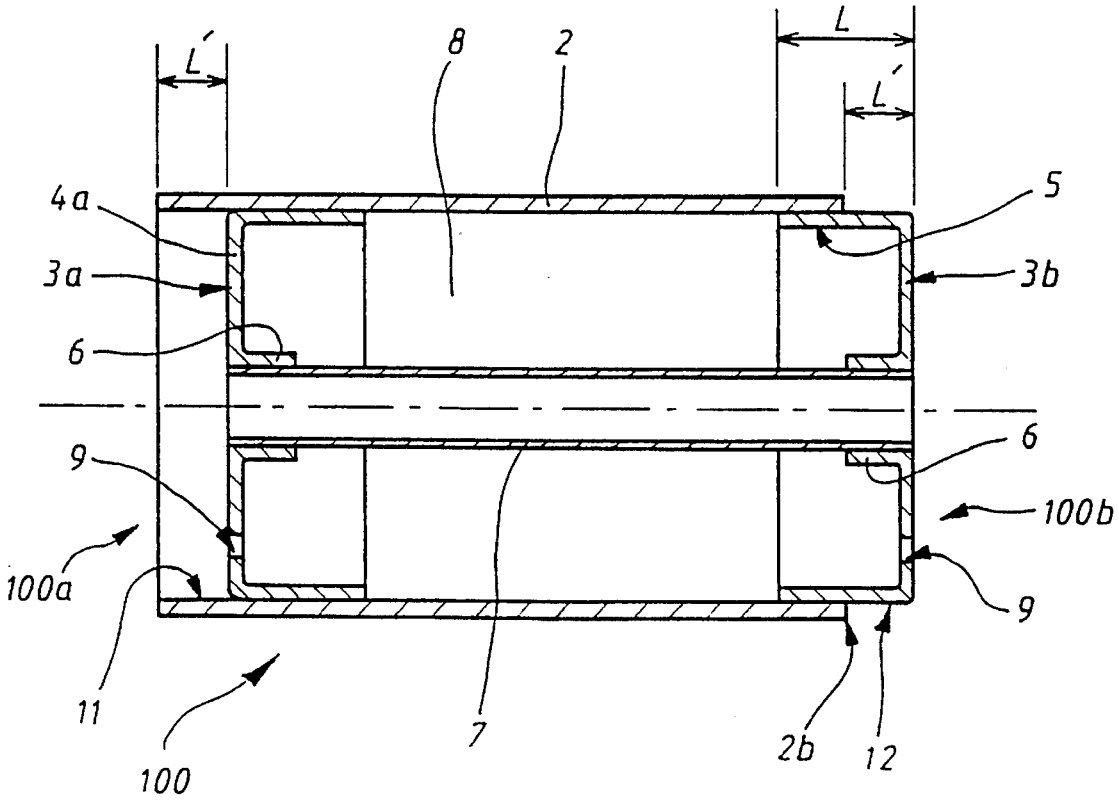
FIG. 2 is a longitudinal half-sectional view of the second container obtained with the process according to the invention.

FIG. 2 shows another form of container 100 obtained with the process according to the invention.

Like the previous container, the container has a tubular cylindrical case 2 made of combustible material and is closed at each end by a cover 3 made of combustible material.

The two covers 3 are identical, and each includes a base 4 integral with a cylindrical edge 5.

Each cover includes a cylindrical axial collar 6 having a cylindrical conduit 7. Conduit 7, made of combustible material, is attached to each cover by gluing onto the collars 6.

Container 100, in its internal volume 8, contains propulsive powder of a known type, not shown, added to container 100 through an opening 9 provided in cover 3 and sealed after filling by a sheet of paper or by an appropriate cap.

From the structural standpoint, container 100 therefore uses the same parts (case 2, covers 3 and conduit 7) as container 1.

Container 100 differs from container 1 through the relative axial position of case 2 and of the assembly formed by the two covers 3 and conduit 7.

In the second embodiment, one end 100*a* of the container 100 supports an initial cover 3*a*, the base of which is placed inside case 2.

Container 100 therefore forms a tubular extension 11 at its first end 100*a*.

A second end 100*b* of container 100 bears a second cover 3*b*, of which one part of cylindrical edge 5 is outside of case 2, thus forming a restriction 12, whose diameter is smaller than the outside diameter of case 2.

Length L' of restriction 12 is approximately equal to that of tubular extension 11.

When the different containers of this form are stacked to form a propulsive charge, restriction 12 of the first container receives a tubular extension 11 integral with a second container.

An arrangement like this ensures that the stack is maintained in a position whereby the tubular conduits 7 are axially aligned.

This arrangement also provides the stack with some rigidity, facilitating its handling.

The length L of edge 5 of covers 3 is chosen to allow the cover to be attached to the case, with part of the edge arranged outside of the case, forming a restriction 12. The length L will be determined according to the mechanical strength of the materials used for case 2 and covers 3.

Restriction 12 must therefore have a length L' that is sufficient to ensure rigid retention, without radial deformation, of the two assembled containers. Length L–L' must also be sufficient to allow rigid attachment of the cover to the case by gluing.

Practically, for containers of which case and covers are made of 3 mm thick cardboard, edge 5 will be of a length equal to or greater than one-quarter of the inside diameter of case 2, i.e., approximately 50 mm for a case whose outside diameter is 158 mm.

Note that the container has a restriction, the length of which can be defined accurately because it is determined on assembly by the relative positioning of cover and case.

In addition, restriction 12 is contained on one side by the end of case 23, having an acute angle 2*b*. This arrangement, when a stack of containers is made, brings each tubular extension 11 onto the restriction of another container, and abuts against the end of the case of the latter. This means that the overall length of the container stack can be controlled easily.

Figure 3:
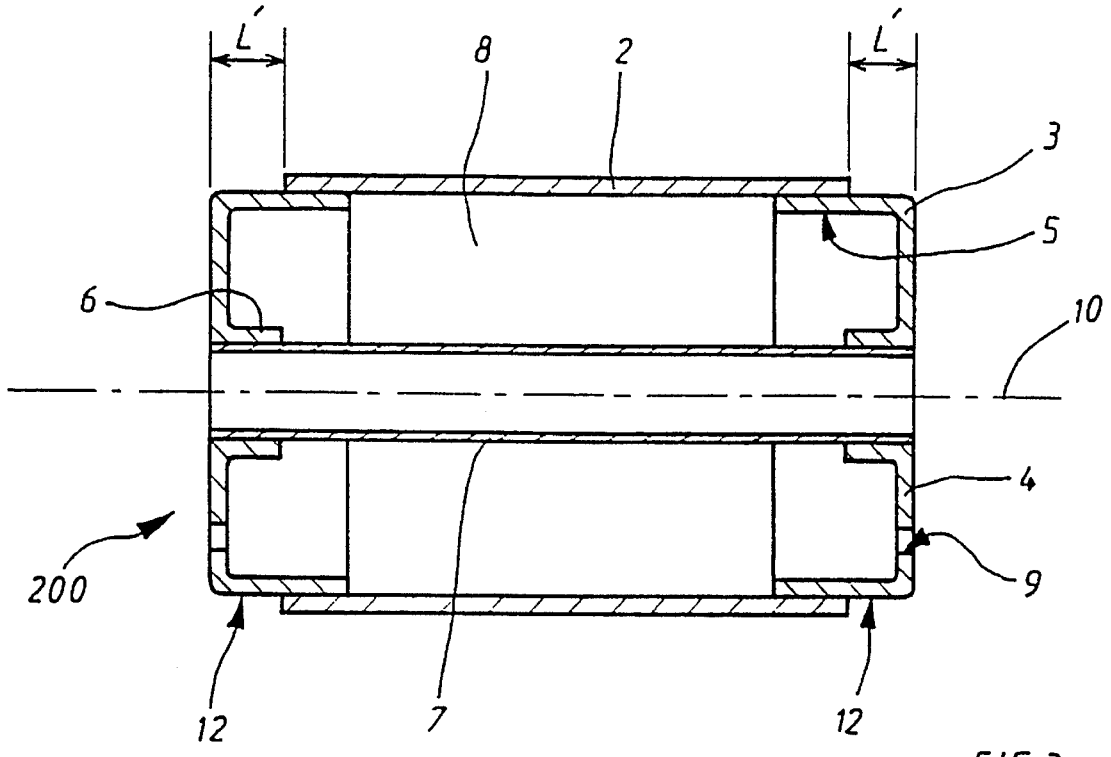
FIG. 3 is a longitudinal half-sectional view of the third container obtained with the process according to the invention.

FIG. 3 shows another form of container 200 obtained with the process according to the invention.

Like the previous container, this container has a cylindrical tubular case 2 closed at each end by a cover 3.

The two covers 3 are identical and each includes a base 4 integral with a cylindrical edge 5.

This container differs from the two previous containers in that each cover is positioned with respect to its case so that part of its cylindrical edge 5 is outside of case 2, forming a restriction 12, whose diameter is smaller than the outside diameter of case 2.

Container 200 also has a restriction 12 at each end, and is substantially symmetrical about its axis 10 and with respect to a normal plane central with respect to axis 10.

Accordingly, it is possible to put the container in place in the chamber of a weapon in any orientation, an advantage from the operational standpoint, in particular with automatic loading systems.

The container can also be made integral with another similar container using an attaching ring (not shown) whose outside diameter equals that of case 2 and which will be positioned on a restriction 12. The length of the ring will be less than or equal to twice the length L' of a restriction.

Figure 4:
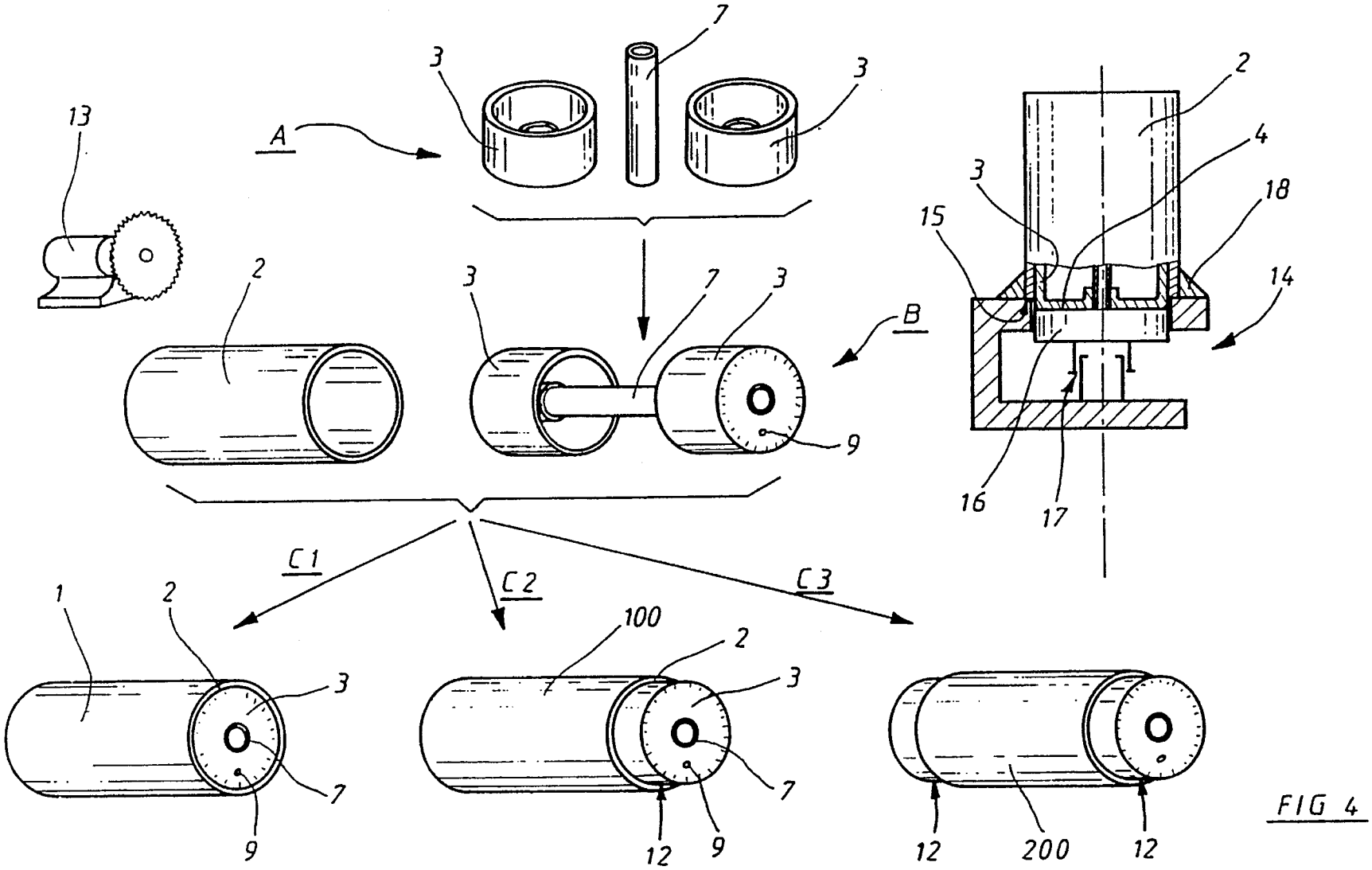
FIG. 4 is a diagram summarizing the various stages of the process of obtaining the containers according to the invention.

From the structural standpoint, container 200 also uses the same parts (case 2, covers 3 and conduit 7) as container 1 and container 100. FIG. 4 schematizes the various stages of this container-production process according to the invention.

Two substantially identical covers 3 (Step A) will be produced. These covers will be obtained, for instance, by molding a combustible carton filled with nitro-cellulose or another energy-generating compound.

As specified above, the covers will have an edge whose length will permit their subsequent positioning in the case with part of the edge located outside of it.

In addition, for instance by molding, conduit 7 can also be made of combustible carton. The assembly (step B) of the two covers 3 and conduit 7 will then be performed. This step will define the internal volume of the final container.

Collars 6 enable the covers to be positioned axially on the conduit in a relatively precise manner. Conduit 7 can be cut before or after the gluing of the covers 3 to a length making it possible to set the desired volume for the container.

The glue will be applied after axial positioning.

In addition, (for instance by molding), a tubular case 2 will be formed of combustible material.

In general, the cases and conduits will be produced with a length corresponding to the maximum length found in the various definitions of the containers. The final length will then be adjusted according to the characteristics of each series of containers produced.

Thus, depending on the type of container desired, case 2 will be cut to an appropriate length by a saw 13.

Subsequently, case 2 and the assembly formed by covers 3 and conduit 7 will be made integral.

Depending upon the length chosen for case 2, it will be possible to form a container 1 as per the initial embodiment described previously (step C1) or a container 100 according to a second embodiment (step C2) or a container 200 according to a third embodiment (step C3) if the case is short enough.

For this purpose, it is a simple matter of axial positioning of the cover/conduit assembly so that a cover has or does not have part of its edge arranged outside of the case thus forming a restriction 12.

It is easy to position axially the case/cover assembly using positioning means such as tool 14 including a retaining surface 15 for case 2 and a plate 16 on which bottom 4 of cover is supported.

The radial position of the case on the retaining surface 15 is given by a circular clamp 18.

The axial position of plate 16 with respect to retaining surface 15 can be adjusted by an actuator 17. This tool also makes it possible to obtain an accurate length L' as desired for restriction 12.

Once the axial position has been determined, the conduit/cover assembly is glued onto the case.

After assembly, the powder is applied to the containers through openings 9 and the ignition system is inserted into conduit 7.

The previous description indicates that it is possible to use the process embodied in the invention for three types of different containers, by using the same components.

It is also easy to modify the geometrical characteristics of a container, in particular its volume and dimensions, by simply adjusting the overall length of case 2 and conduit 7.

Therefore, the invention proposes a process for the manufacturing of a container that is particularly simple because it offers a simple and low-cost method for obtaining different types of containers of different shapes and volumes.

As an alternative, it is possible not to carry out step 8 of the previous process and to position each cover individually with respect to the case, by means of tool 14, before gluing it. The conduit is then placed and glued last of all.

In this way, it is possible to provide covers that have no openings 9. In this case, the powder will be applied to the case, equipped with the first cover. The second cover will be positioned and attached after filling.

It is also possible to use other means of positioning the covers with respect to the case.

Figure 5:
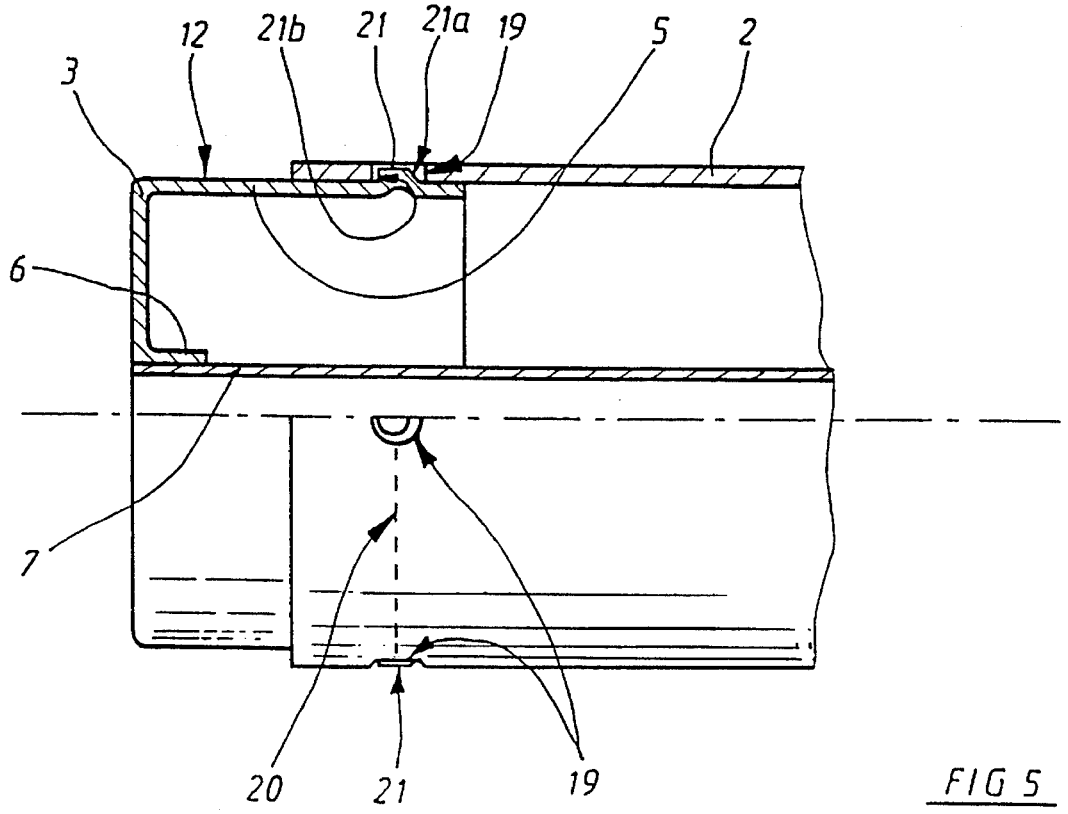
FIG. 5 is a longitudinal sectional view of the end of a container according to the first variant of the invention.

FIG. 5 shows one end of a container of which case 2 has radial openings 19 at one end, set out regularly over a circular crown (represented by dotted lines 20).

These openings accommodate pins 21 integral with cover 3 to ensure a bond between cover and case by clipping. The pins have a tapered profile 21*a* to facilitate the insertion of the cover and a straight profile 21*b* to ensure an axial stop.

The axial position of openings 19 is defined by a drilling tool. In FIG. 5, the position chosen for crown 20 makes it possible to position the cover in such a way that a part of its cylindrical edge 5 is located outside of the case, thus forming a restriction 12.

In the previously described process, a drilling stage will be interposed before the cutting stage of case 2.

Depending on the axial position chosen for the openings provided in each end of the case, it will then be possible to produce containers of one or the other of the three types described previously with reference to FIGS. 1 to 3.

The covers, positioned by clipping, can also be glued onto the case.

Figure 6:
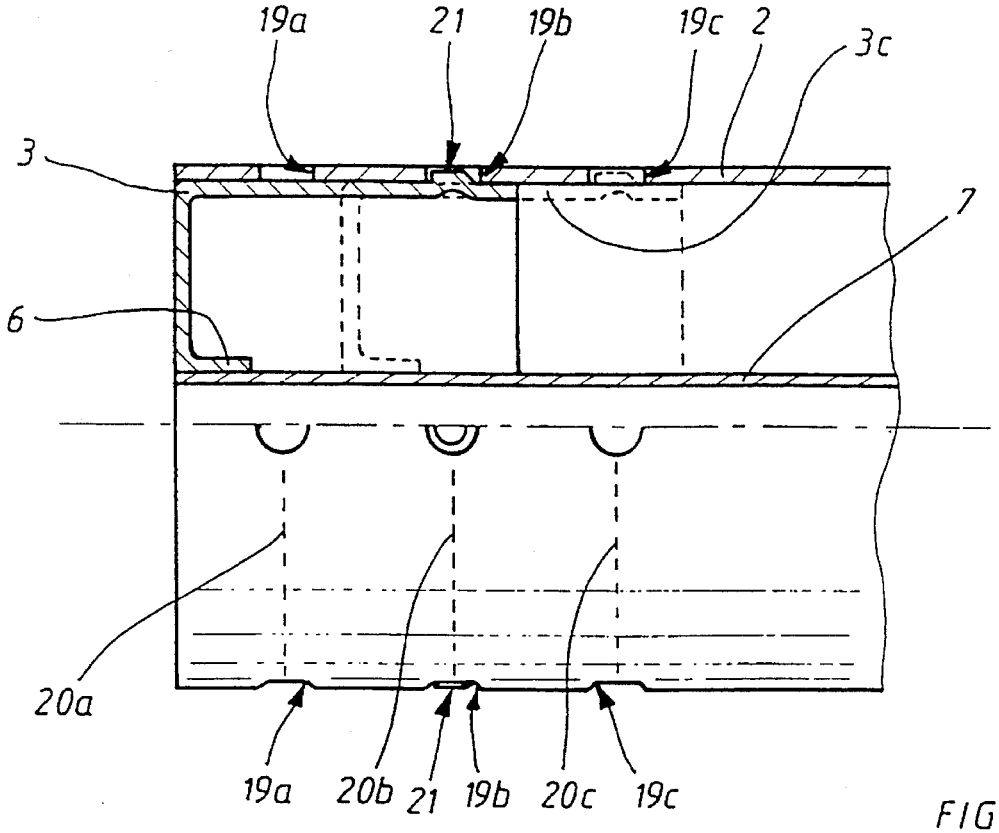
FIG. 6 is a longitudinal sectional view of the end of a container according to the second variant of the invention.

In another alternative shown in FIG. 6, at each end of the case, radial openings 19*a*, 19*b* and 19*c* will be formed, set out at regular intervals over several circular crowns (respectively: 20*a*, 20*b*, 20*c*).

On assembly it will then be possible to set each cover in three different axial positions depending upon the openings in which pins 21 are inserted. For instance, a cover positioned by openings 19*c* is shown by broken lines 3*c*.

Accordingly fast assembly of the containers is possible in several configurations. However, it imposes the prior definition of the length of the case which is the same for the three types of containers.

Figure 7:
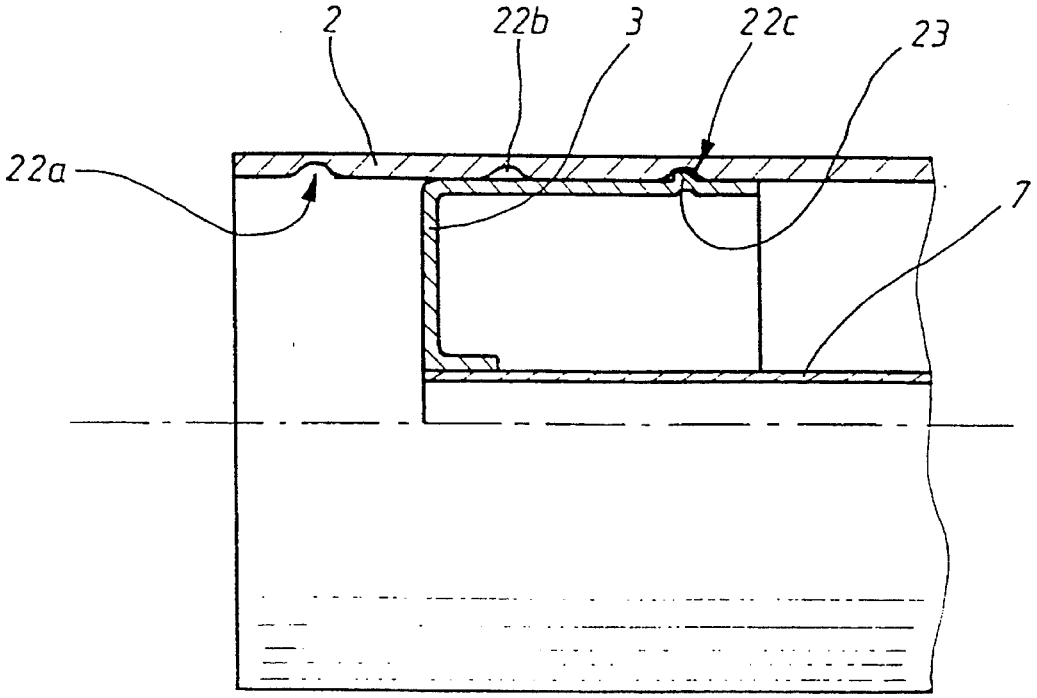
FIG. 7 is a longitudinal sectional view of the end of a container according to the third variant of the invention.

FIG. 7 shows another variant in which the structure for positioning include clipping means comprising three grooves 22*a*, 22*b*, 22*c* formed in the internal cylindrical surface of case 2 and at each end of it.

These grooves have a rounded profile and are obtained by molding the case.

They are intended to receive a circular bolster 23 supported by cover 3.

After the relative positioning as per the chosen configuration, the covers are glued onto the case.

As an alternative, and for a reduced case thickness, the grooves can be molded so that the case thickness is constant at the grooves.

The outer surface of the case will then have bolsters corresponding to the different grooves formed in the inner surface. A case such as this must be defined with an appropriate external diameter so that it can be positioned in the weapon chamber.

Figure 8:
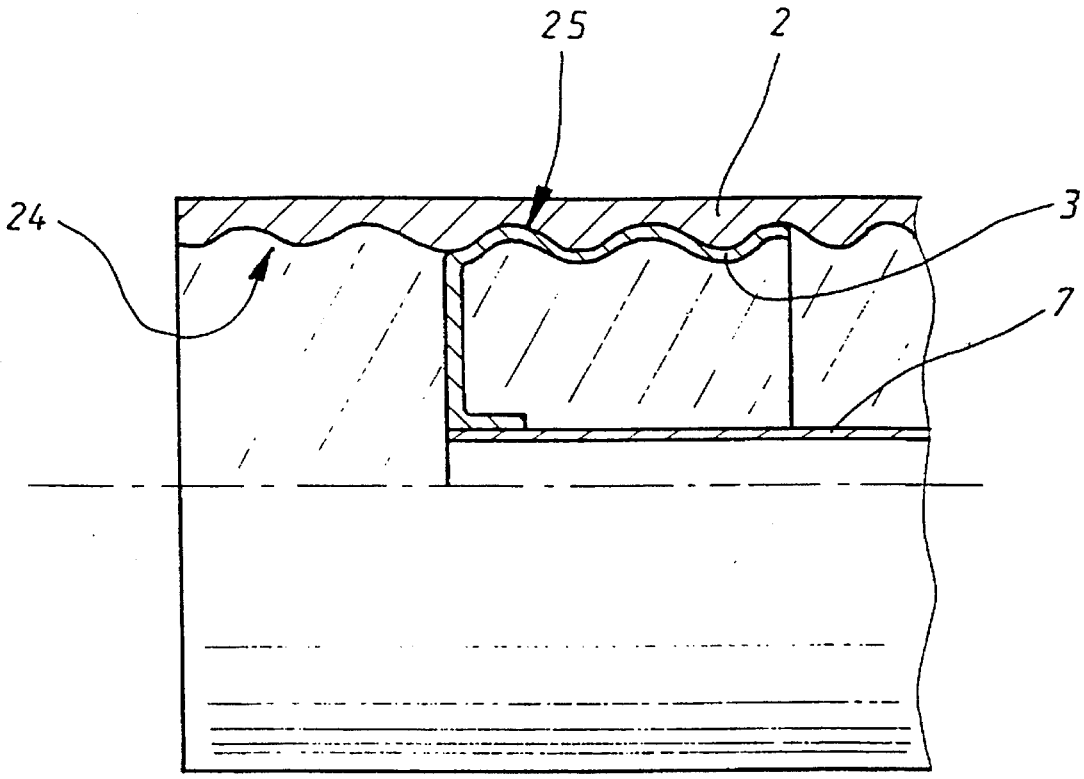
FIG. 8 is a longitudinal sectional view of the end of a container according to the fourth variant of the invention.

FIG. 8 is a last variant in which case 2 bears, on its cylindrical inner surface, a threaded profile 24 coworking with a complementary profile 25 supported by edge 5 of cover 3.

The threaded profile is provided over the entire internal surface of the case.

The threaded profiles are rounded off so as to facilitate formation thereof by molding.

By screwing in or out the cover 3, it is possible to set it in the desired axial position.

After positioning, the cover is immobilized by gluing.

With a variant like this, it is easy to obtain different types of containers. The threading spreads over the entire length of the case so that its length can be adjusted according to the desired characteristics without destroying the positioning structures. When containers are obtained in this way, according to the configuration shown in FIG. 2, tubular extension 11 has a threaded profile 24 and the restriction 12 has a threaded profile 25.

These threaded profiles then make it possible to secure the two containers together in order to form a charge.

When a variant of the containers is produced in accordance with the configuration shown in FIG. 3, each restriction 12 will bear a threaded profile 25. It will then be possible to make several containers integral by using an interconnecting ring also including a threaded profile.

It is possible to set a constant thickness on the case. The outer surface of the case will then have a threaded relief profile corresponding to threaded profile 24 provided on the inner surface. A case like this must be defined with an appropriate external diameter so that it may be positioned in the weapon chamber.

As an alternative, it is possible to provide for a threaded profile that does not extend over the entire internal cylindrical surface of the case. In this case, a threaded profile will be formed at each end of the case and over a sufficient length so that the covers may be disposed in desired axial positions.

We claim:

1. A container for a propulsive charge comprising a case of combustible material closed at each end by a cover also made of combustible material, each said cover having a base integral with a cylindrical edge whose outside diameter approximately equals an inside diameter of the case, said covers being connected to the case by a connection device, each of the covers being attachable to the case such that each cylindrical edge is one of outside of the case, thus forming a restriction, inside the case, thus forming an extension, and substantially flush with a corresponding end of the case.

2. A container according to claim 1, wherein the connection device includes clipping attachments having radial openings provided on at least one end of the case, set out regularly on at least one circular crown, said radial openings being adapted to accommodate pins integral with each cover.

3. A container according to claim 2, wherein the case includes, at least at one end, radial openings set out regularly on at least two axially spaced circular crowns, said radial opening being adapted to receive pins integral with each cover to provide a link by clipping each cover and the case together in said at least two axial positions.

4. A container according to claim 1, wherein the connection device includes clipping attachments having at least two annular grooves in an internal surface of the case at one end of the container, said at least two annular grooves being adapted to receive a bolster integral with a cover to provide interconnection by clipping the cover and the case together in said at lest two axial positions.

5. A container according to claim 1, wherein the connection device includes at least one threaded profile formed on an internal cylindrical surface of said case that is cooperable with a complementary profile supported by said edge of each cover.

6. A container according to claim 1, wherein the covers are attached to the case such that:

a first end of the case supports a first cover, the base of the first cover being placed within the case so that an overhanging portion of the case forms a tubular extension at said first end, a second end of the case supports a second cover, the base of which is located outside of the case thus forming a restriction adapted to receive a tubular extension of another container, and a length of the restriction is approximately equal to a length of the tubular extension.

7. A container according to claim 1, wherein each of the covers is attached to the case such that each cylindrical edge is outside of the case, thus forming a restriction at each end.

8. A container according to claim 1, wherein each of the covers is attached to the case such that each base is substantially flush with a corresponding end of the case.

9. A process for manufacturing a container for a propulsive charge comprising:

positioning two covers made of combustible material relative to a tubular case of combustible material, each of said covers including a base integral with a cylindrical edge having an outside diameter equal to an inside diameter of the case, wherein each of the covers is positionable on the case such that each cylindrical edge is one of outside of the case, thus forming a restriction, inside the case, thus forming an extension, and substantially flush with a corresponding end of the case; and attaching the covers to the case.

10. A process according to claim 9, wherein the positioning step includes positioning using a tool with a plate for axially positioning each base with respect to the case in said at least two axial positions.

11. A process according to claim 9, wherein the positioning step includes positioning using radial openings drilled over at least one end of the case and set out regularly on at least one circular crown, said radial openings being designed to receive pins integral with each cover to ensure interconnection by clipping each cover and the case so that the circular crown can be set in different axial positions on the case and so that each cover may be attached in a selected one of said at least two axial positions.

12. A process according to claim 9, wherein the positioning step includes positioning using at least two annular grooves supported by at least one of the ends of the case, said at least two annular grooves being adapted to accommodate a bolster integral with each cover to ensure connection of the cover and the case by clipping in said at least two axial positions.

13. A process according to claim 9, wherein the positioning step includes positioning using at least one threaded profile provided in the case, said at least one threaded profile being adapted to cooperate with a complementary profile provided in the edge of each cover.

14. A container made according to the process of claim 9.

15. An apparatus for manufacturing a container for a propulsive charge comprising:

means for positioning two covers made of combustible material relative to a tubular case of combustible material, each of said covers including a base integral with a cylindrical edge having an outside diameter equal to an inside diameter of the case, wherein each of the covers is positionable on the case such that each cylindrical edge is one of outside of the case, thus forming a restriction, inside the case, thus forming an extension, and substantially flush with a corresponding end of the case; and means for attaching the covers to the case.

16. The apparatus according to claim 15, wherein the means for attaching includes glue.

17. The apparatus according to claim 15, wherein the means for positioning includes a plate mounted on an adjustable actuator, said plate being movable with said adjustable actuator to position each of the covers in said at least two different positions.

* * * * *